US011846476B2

(12) United States Patent
Underwood et al.

(10) Patent No.: US 11,846,476 B2
(45) Date of Patent: Dec. 19, 2023

(54) EJECTOR FOR FIREARM

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/960,587

(22) Filed: Oct. 5, 2022

(65) Prior Publication Data

US 2023/0213296 A1 Jul. 6, 2023

Related U.S. Application Data

(60) Provisional application No. 63/253,301, filed on Oct. 7, 2021.

(51) Int. Cl.
*F41A 15/14* (2006.01)

(52) U.S. Cl.
CPC ..... *F41A 15/14* (2013.01)

(58) Field of Classification Search
CPC ..... F41A 15/14
See application file for complete search history.

(56) References Cited

U.S. PATENT DOCUMENTS

| | | | |
|---|---|---|---|
| 1,085,698 | A | 2/1914 | Nelson |
| 1,168,024 | A | 1/1916 | Nelson |
| 1,349,345 | A | 8/1920 | Payne |
| 1,365,355 | A | 1/1921 | Thompson |
| 2,089,671 | A | 8/1937 | Stecke |
| 2,182,693 | A | 12/1939 | Harton |
| 2,370,189 | A | 2/1945 | Penney |
| 2,651,974 | A | 9/1953 | Simpson |
| 2,691,232 | A | 10/1954 | Hoopes |
| 2,717,535 | A | 9/1955 | Taylor |
| 2,978,826 | A | 4/1961 | Ivy |
| 3,101,648 | A | 8/1963 | Walther |
| 3,283,435 | A | 11/1966 | Koch |
| 3,415,000 | A | 12/1968 | Koucky et al. |
| 3,540,147 | A | 11/1970 | Cream et al. |
| 3,715,826 | A | 2/1973 | Seifried |
| 3,848,510 | A | 11/1974 | Wolpert |
| 4,031,648 | A | 6/1977 | Thomas |
| 4,246,830 | A | 1/1981 | Krieger |
| 4,420,899 | A | 12/1983 | Bourlet et al. |
| 4,440,062 | A | 4/1984 | McQueen |
| 4,521,985 | A | 6/1985 | Smith et al. |
| 4,549,465 | A | 10/1985 | Charron |
| 4,594,935 | A | 6/1986 | Smith |
| 4,619,062 | A | 10/1986 | Johnson |
| 4,742,634 | A | 5/1988 | Swenson |
| 4,815,226 | A | 3/1989 | Ruger |
| 5,036,612 | A | 8/1991 | Jennings |

(Continued)

FOREIGN PATENT DOCUMENTS

| | | | |
|---|---|---|---|
| DE | 1242477 | B | 6/1967 |
| DE | 3627573 | A1 | 2/1988 |
| WO | 2005108900 | A1 | 11/2005 |

*Primary Examiner* — J. Woodrow Eldred

(57) ABSTRACT

An ejector mechanism for a firearm includes an ejector disposed at a forward face of a bolt. The ejector includes a hole designed to provide clearance for the firing pin to pass at least partially through the ejector. The hole may include a counterbore on a rear side of the ejector.

20 Claims, 11 Drawing Sheets

(56) References Cited

U.S. PATENT DOCUMENTS 5,090,147 A 2/1992 Pastor
5,105,570 A 4/1992 Lishness et al.
5,259,137 A 11/1993 Blenk et al.
5,299,374 A 4/1994 Mathys
5,386,659 A 2/1995 Vaid et al.
5,388,362 A 2/1995 Melcher
5,438,784 A 8/1995 Lenkarski et al.
5,447,092 A 9/1995 Dobbins
5,537,769 A 7/1996 Hargraves et al.
5,640,794 A 6/1997 Gardner et al.
5,926,987 A 7/1999 Novak
6,073,380 A 6/2000 Hauser et al.
6,079,138 A 6/2000 Meaker
6,141,895 A 11/2000 Rost et al.
6,374,526 B1 4/2002 Mochak
6,457,271 B1 10/2002 Vaid et al.
6,655,066 B2 12/2003 Fluhr
6,665,973 B1 12/2003 Peev
6,820,606 B1 11/2004 Duffey
6,880,281 B1 4/2005 Orr
6,931,978 B1 8/2005 Dionne
7,140,141 B2 11/2006 Vaid
7,194,833 B1 3/2007 Curry
7,299,737 B2 11/2007 Hajjar et al.
7,516,570 B2 4/2009 Stone
7,571,671 B2 8/2009 Engel
7,617,628 B2 11/2009 Curry
7,703,230 B2 4/2010 Curry et al.
7,721,639 B2 5/2010 Wössner
7,770,507 B1 8/2010 Hajjar et al.
7,810,268 B1 10/2010 McGarry
7,810,269 B2 10/2010 Zukowski et al.
7,866,077 B2 1/2011 Constant et al.
7,930,848 B2 4/2011 Dye, Jr.
7,958,661 B2 6/2011 Strayer
8,015,742 B2 9/2011 Zedrosser
8,033,043 B2 10/2011 McGarry
8,122,634 B2 2/2012 Constant et al.
8,191,298 B2 6/2012 Cash et al.
8,359,778 B2 1/2013 Doll et al.
8,438,768 B2 5/2013 Kallio
8,448,363 B2 5/2013 Fargnoli et al.
8,459,165 B2 6/2013 Doll et al.
8,572,878 B2 11/2013 Gentilini et al.
8,656,619 B2 2/2014 Popikov
8,667,881 B1 3/2014 Hawbaker
8,726,555 B2 5/2014 Carr
8,820,211 B1 9/2014 Hawbaker
8,826,576 B2 9/2014 Lewis
8,844,425 B2 9/2014 Mueller
8,863,425 B2 10/2014 Lee
8,925,232 B2 1/2015 Silveira
8,935,872 B2 1/2015 Zukowski
8,955,422 B1 2/2015 Schumacher
8,959,818 B2 2/2015 Mayerl
9,038,525 B2 5/2015 Sullivan et al.
9,217,614 B2 12/2015 Pizano
9,222,742 B2 12/2015 Steuwer et al.
9,347,738 B1 5/2016 Schumacher
9,482,481 B2 11/2016 LaValley et al.
9,488,423 B2 11/2016 Sullivan et al.
9,541,341 B2 1/2017 Macy
9,835,397 B2 12/2017 Stussak
9,964,369 B2 5/2018 Garrow
10,101,102 B2 10/2018 Eitan et al.
10,151,544 B1 12/2018 Sugg
10,386,142 B2 8/2019 Brown
10,401,102 B1 9/2019 Carroll
10,436,530 B2 10/2019 Overstreet et al.
10,557,673 B2 2/2020 Overstreet et al.
11,313,633 B1 * 4/2022 Richey ..... F41A 15/14
2005/0132627 A1 6/2005 Wossner et al.
2005/0257682 A1 11/2005 Hajjar et al.
2006/0266209 A1 11/2006 Grabowski
2008/0078284 A1 4/2008 Murello
2010/0180760 A1 * 7/2010 Polston ..... F41A 3/54
89/139
2010/0186581 A1 7/2010 Hajjar et al.
2010/0229447 A1 9/2010 Metzger
2010/0287806 A1 11/2010 Marfione et al.
2011/0232148 A1 9/2011 Cain et al.
2011/0271827 A1 11/2011 Larson et al.
2013/0036900 A1 2/2013 Mueller
2014/0041518 A1 2/2014 Neitzling
2014/0075807 A1 * 3/2014 Lewis ..... F41A 15/14
42/25
2015/0219413 A1 8/2015 Karimullah et al.
2015/0253096 A1 9/2015 Lee
2015/0308784 A1 10/2015 Cho
2015/0068092 A1 12/2015 Kallio
2016/0010938 A1 1/2016 Merkley et al.
2016/0033218 A1 2/2016 Folkestad et al.
2016/0047614 A1 2/2016 Larson, Jr.
2016/0178303 A1 6/2016 Macy
2016/0187082 A1 6/2016 Pizano
2016/0187090 A1 6/2016 Mather et al.
2016/0187092 A1 6/2016 Mather et al.
2016/0252316 A1 9/2016 Garrow
2016/0377364 A1 12/2016 Santos Reis
2018/0112944 A1 4/2018 Underwood et al.
2018/0142981 A1 5/2018 Collazo et al.
2018/0224227 A1 8/2018 Durham, III
2019/0271524 A1 9/2019 Khoshnood
2020/0072567 A1 3/2020 Michut
2021/0108870 A1 4/2021 Underwood et al.
2022/0003512 A1 1/2022 Underwood et al.
2023/0099273 A1 * 3/2023 Craig ..... F41A 15/14
42/25

* cited by examiner

EJECTOR FOR FIREARM

CROSS REFERENCE TO RELATED APPLICATION

This application is related to and claims priority benefit from U.S. Provisional Application No. 63/253,301 ("the '301 application"), filed on Oct. 7, 2021 and entitled "EJECTOR FOR FIREARM." The '301 application is hereby incorporated in its entirety by this reference.

FIELD OF THE INVENTION

The field of the invention relates to firearms, particularly ejector mechanisms for ejecting a shell or cartridge from the firearm during manual or automated (semi-automatic or automatic) operation of the firearm.

BACKGROUND

Many modern firearms (including handguns, rifles, carbines, shotguns, etc.) rely on at least one of an extractor mechanism and an ejector mechanism for expelling a cartridge or cartridge case from the firearm when the bolt moves away from the chamber. The ejector mechanism may be based on a mechanical operation and/or may be operated by a spring. In addition, the ejector mechanism may be located or attached to a lower receiver, an upper receiver, a bolt, or any other relevant portion of the firearm. Many firearms and related accessories are designed for compatibility with the AR-15 variant (civilian) or M16/M4 (military) firearm platform (i.e., collectively, AR-15 style firearms). Many of these products follow traditional designs based on industry standards and/or military specification (milspec).

To simplify the firearm operating system, to increase reliability, and to increase consistency of the ejection pattern for cartridges or cartridge cases exiting the firearm, it may be desirable to design a new ejection mechanism located near the center of the bolt face.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an ejector mechanism for a firearm comprises: an ejector disposed at a forward face of a bolt, wherein the ejector comprises a hole designed to provide clearance for the firing pin to pass at least partially through the ejector.

According to certain embodiments of the present invention, an ejector mechanism for a firearm comprises: an ejector disposed at a forward face of a bolt, wherein at least a portion of the ejector is disposed at a center of the forward face of the bolt.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments in FIGS. 1A-11B show components of various semi-automatic or automatic firearms, the features, concepts, and functions described herein are also applicable (with potential necessary alterations for particular applications) to handguns, rifles, carbines, shotguns, or any other type of firearm, including firearms that operate manually (e.g., bolt action, lever action, or other relevant firearms). Furthermore, the embodiments may be compatible with various calibers including rifle calibers such as, for example, 5.56×45 mm NATO, 0.223 Remington, 7.62×51 mm NATO, .308 Winchester, 7.62×39 mm, 5.45×39 mm; pistol calibers such as, for example, 9×19 mm, 0.45 ACP, 0.40 S&W, 0.380 ACP, 10 mm Auto, 5.7×28 mm, .22 Long Rifle; and shotgun calibers such as, for example, 12 gauge, 20 gauge, 28 gauge, 0.410 gauge, 10 gauge, 16 gauge. The illustrated embodiments focus on an upper receiver for the AR-15 variant (civilian) or M16/M4 (military) firearm platform (i.e., AR-15 style firearms); however, the concepts and features described herein can be are also applicable (with potential necessary alterations for particular applications) to other components of AR-15 style firearms and to components of other firearms.

Figure 1:
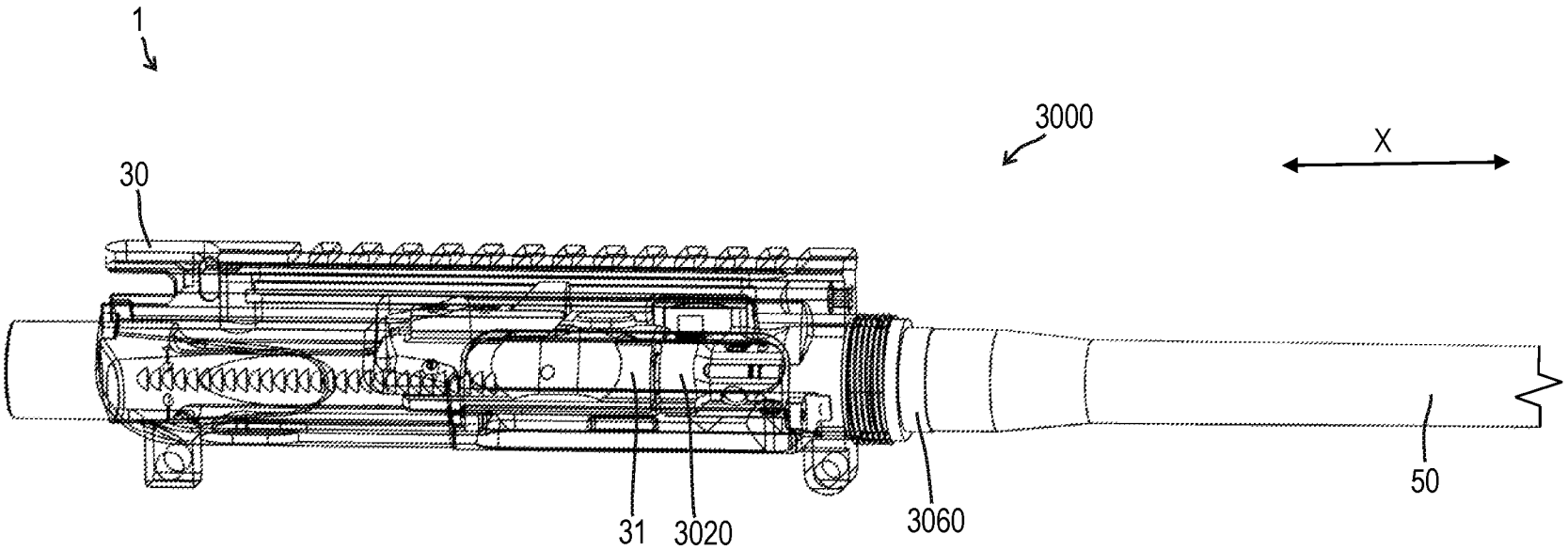
FIG. 1 is a perspective view of a firearm operating system for a firearm according to certain embodiments of the present invention.

In some cases, a firearm 1 includes a firearm operating system 3000, an upper receiver 30, and a barrel 50 (see FIG. 1). Other components, including, for example, a charging handle, a buffer tube, a lower receiver, a fire control group, a stock, a grip, a magazine, and a handguard, are not illustrated for simplicity.

According to certain embodiments of the present invention, as shown in FIGS. 1-10, a firearm operating system 3000 may include a bolt 3020, an ejector mechanism 100, an extractor mechanism 200, and a barrel extension 3060. In some cases, the firearm operating system 3000 is located within the upper receiver 30. The firearm operating system 3000 may be designed as an assembly of components to fit within a standard upper receiver (e.g., upper receiver 30 shown transparent in FIG. 1) for a known modular firearm such that the upper receiver 30 (including the firearm operating system 3000) can interface with a standard lower receiver. For example, the firearm operating system 3000 may be designed to function and engage with (i) components of AR-15 variant (civilian) or M16/M4 (military) firearms; (ii) components of AR-10 variant firearms; or (iii) components of any other relevant firearm.

Figure 2:
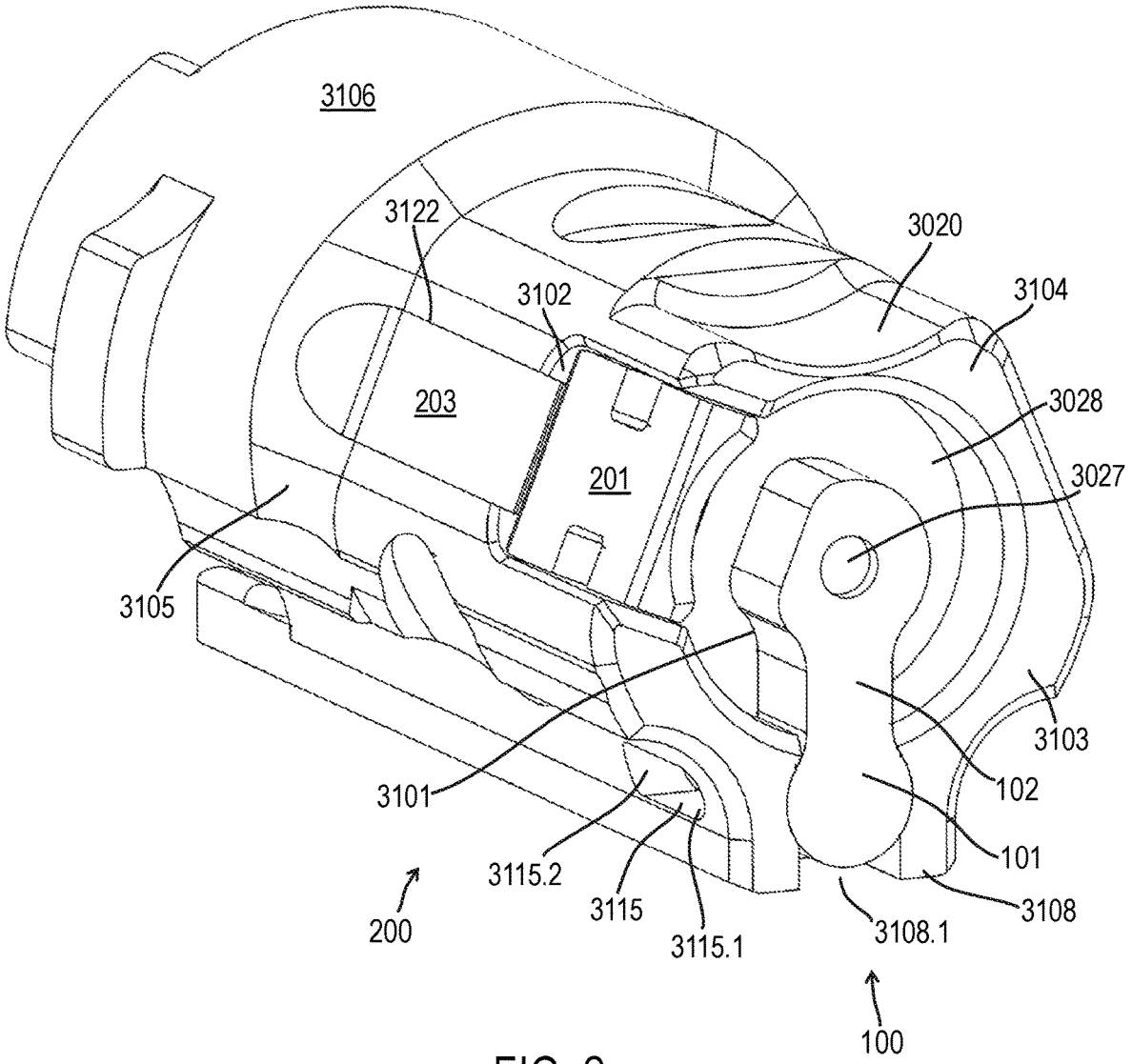
FIG. 2 is a front right perspective view of a bolt including an ejector mechanism of the firearm of FIG. 1.
Figure 3:
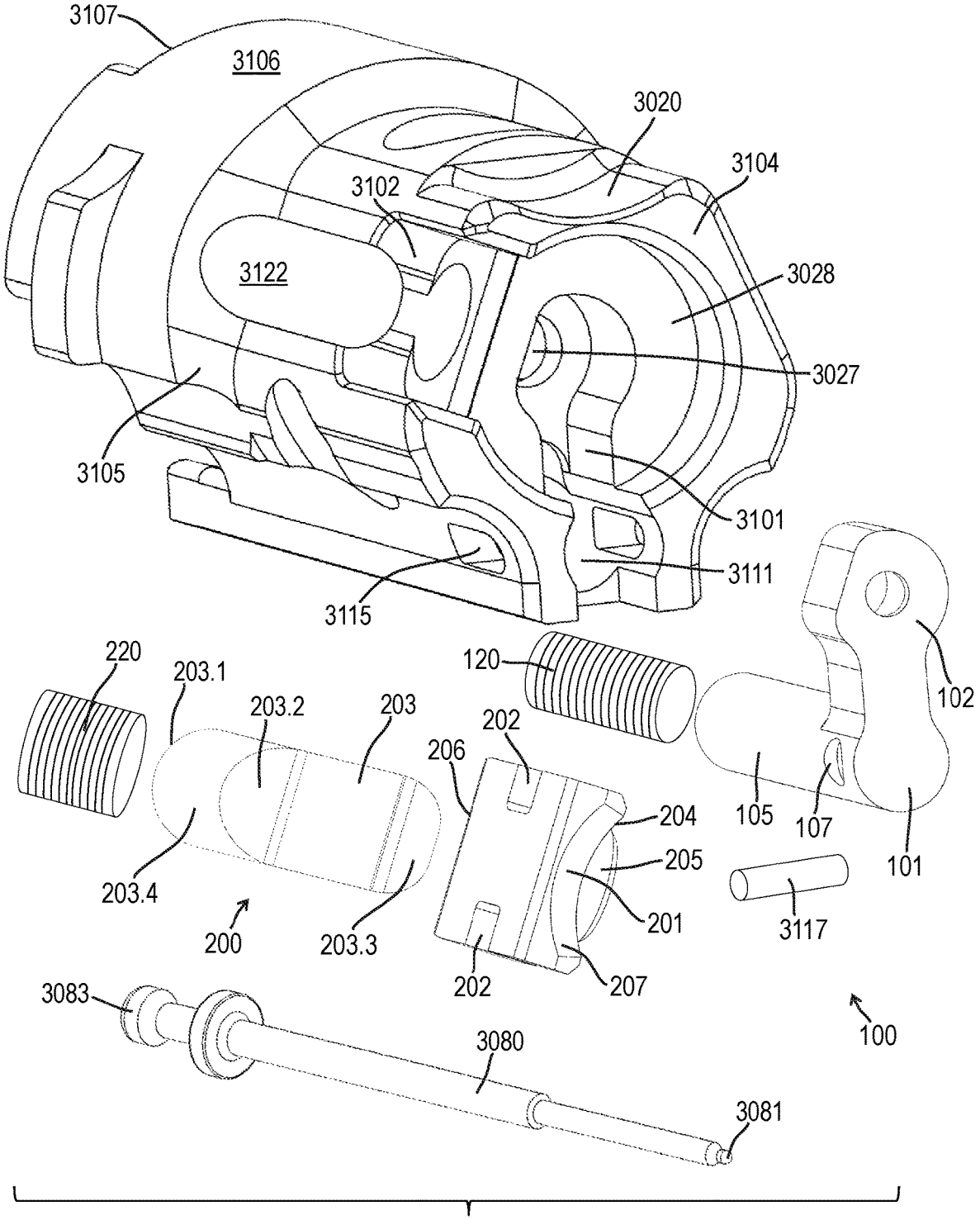
FIG. 3 is an exploded perspective view of the bolt of FIG. 2.
Figure 4A:
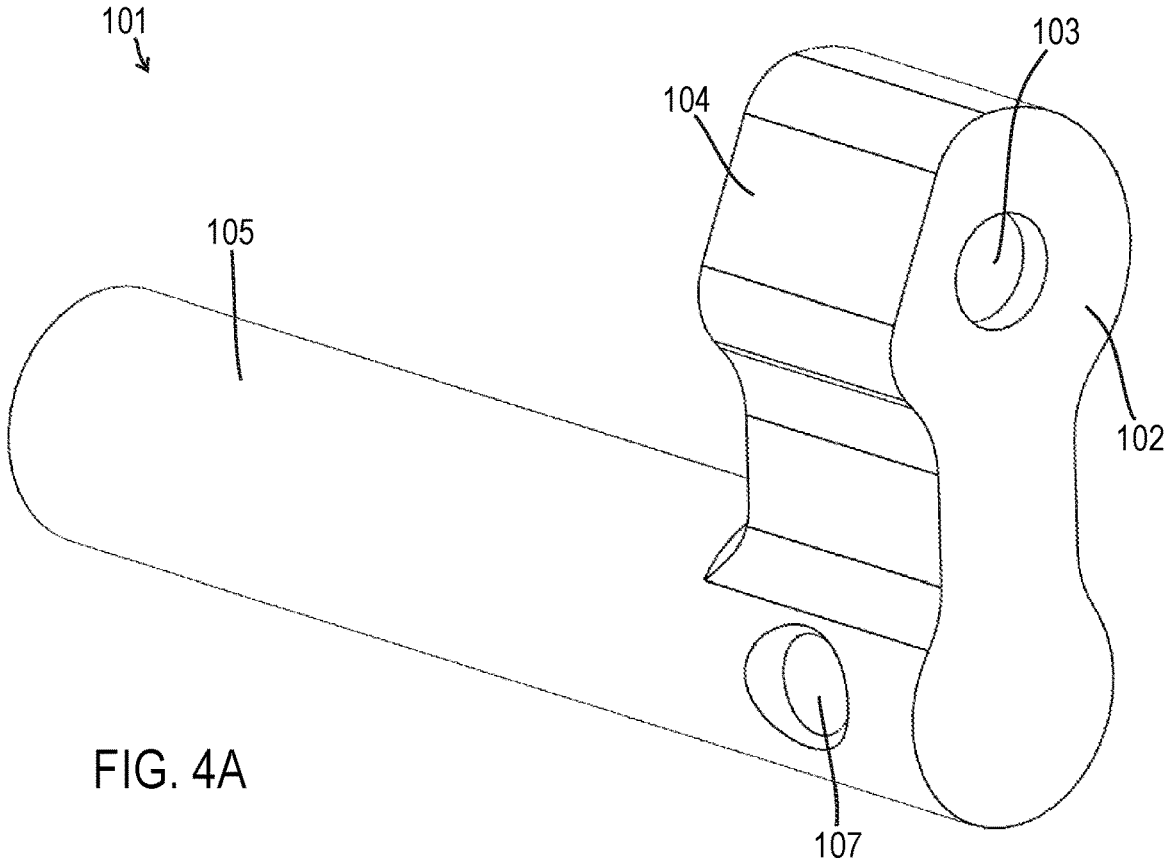
FIG. 4A is a front right perspective view of an ejector of the bolt of FIG. 2.
Figure 4B:
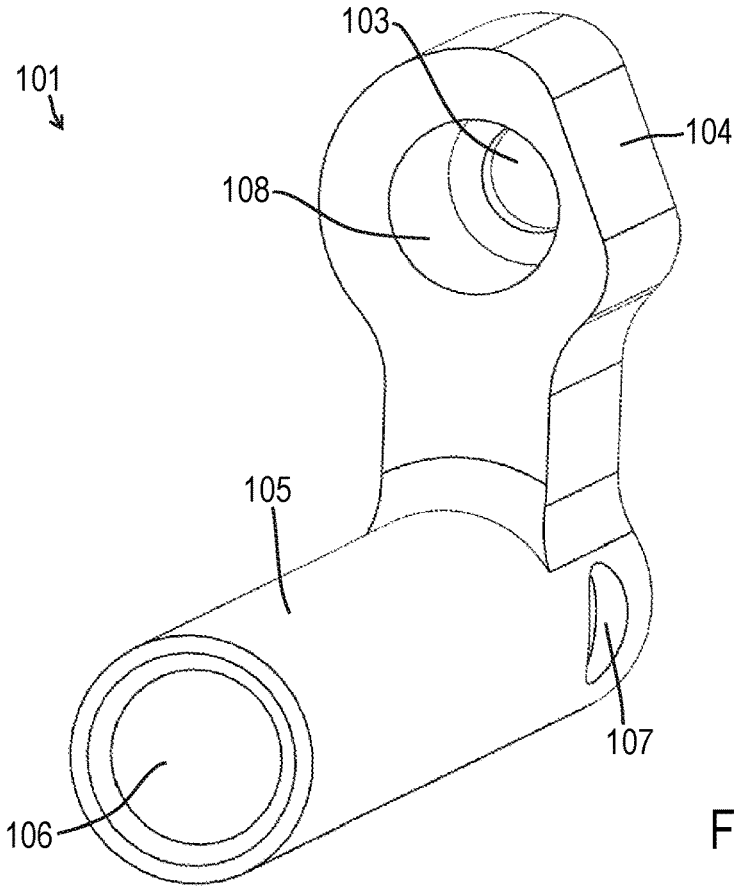
FIG. 4B is a rear right perspective view of the ejector of FIG. 4A.

As shown in FIGS. 2, 3, and 5, in some cases, the overall shape of the bolt 3020 includes a forward portion 3104 and a rear portion 3106. The forward portion 3104 includes non-circular profile with at least one flat lateral portion connected by a curved upper portion and an approximately rectangular lower portion 3108. The rear portion 3106 may be approximately cylindrical.

The ejector mechanism 100 may include an ejector 101, a spring 120, and a retaining pin 3117 (see FIG. 3). The extractor mechanism 200 may include an extractor 201, an extractor plunger 203, and a spring 220.

Figure 9:
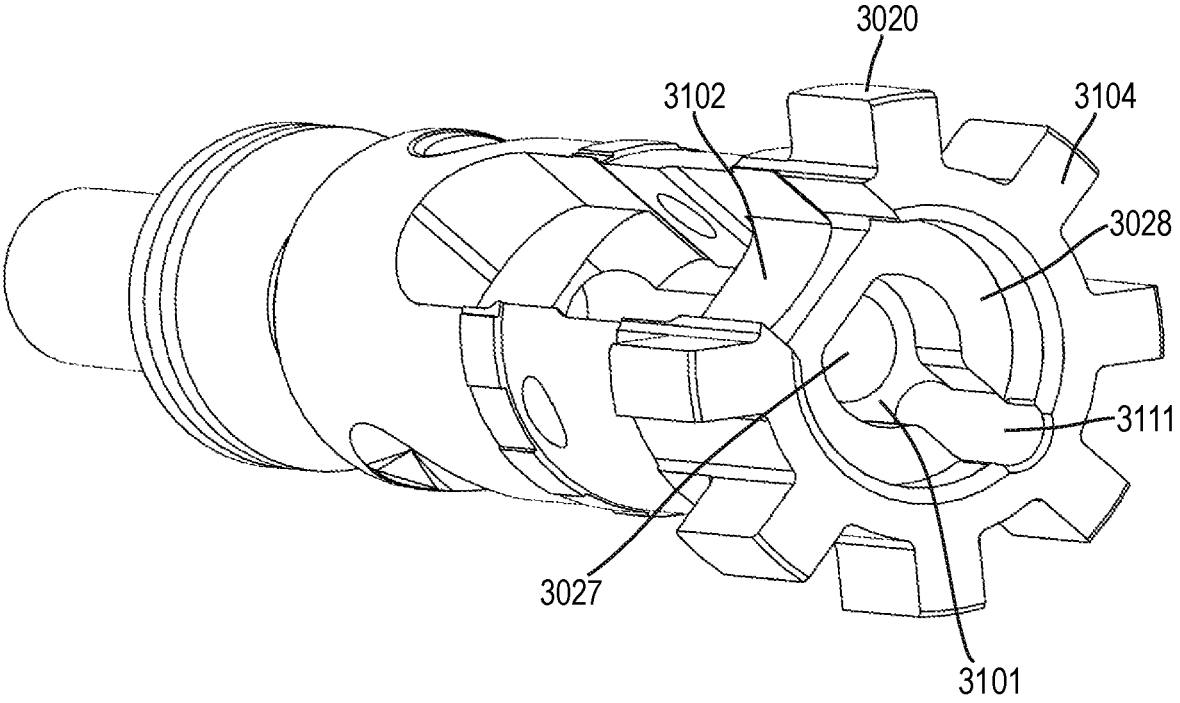
FIG. 9 is a front right perspective view of the bolt of FIG. 7.
Figure 10:
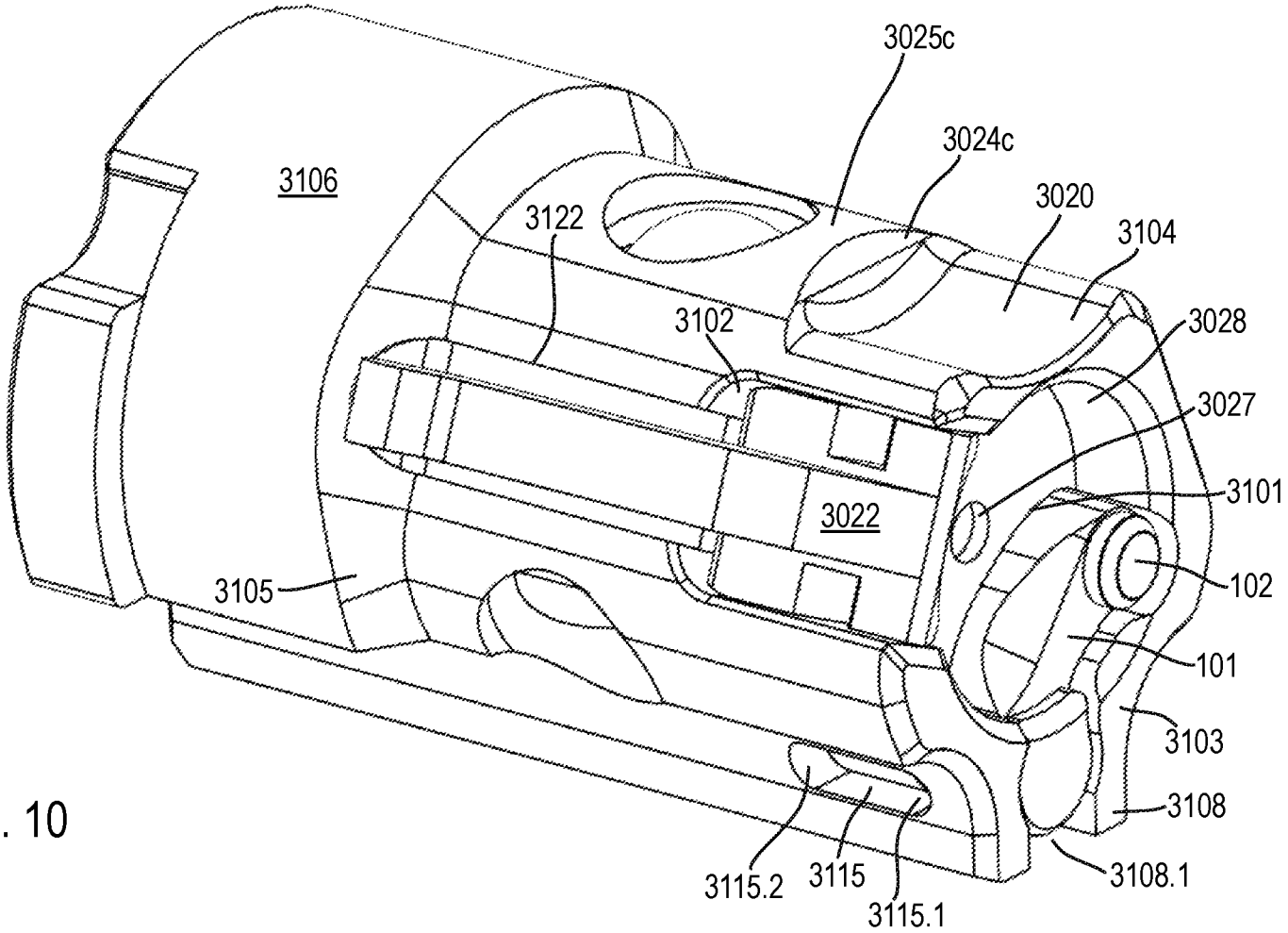
FIG. 10 is a front right perspective view of a bolt including an ejector mechanism of the firearm of FIG. 1.
Figure 11A:
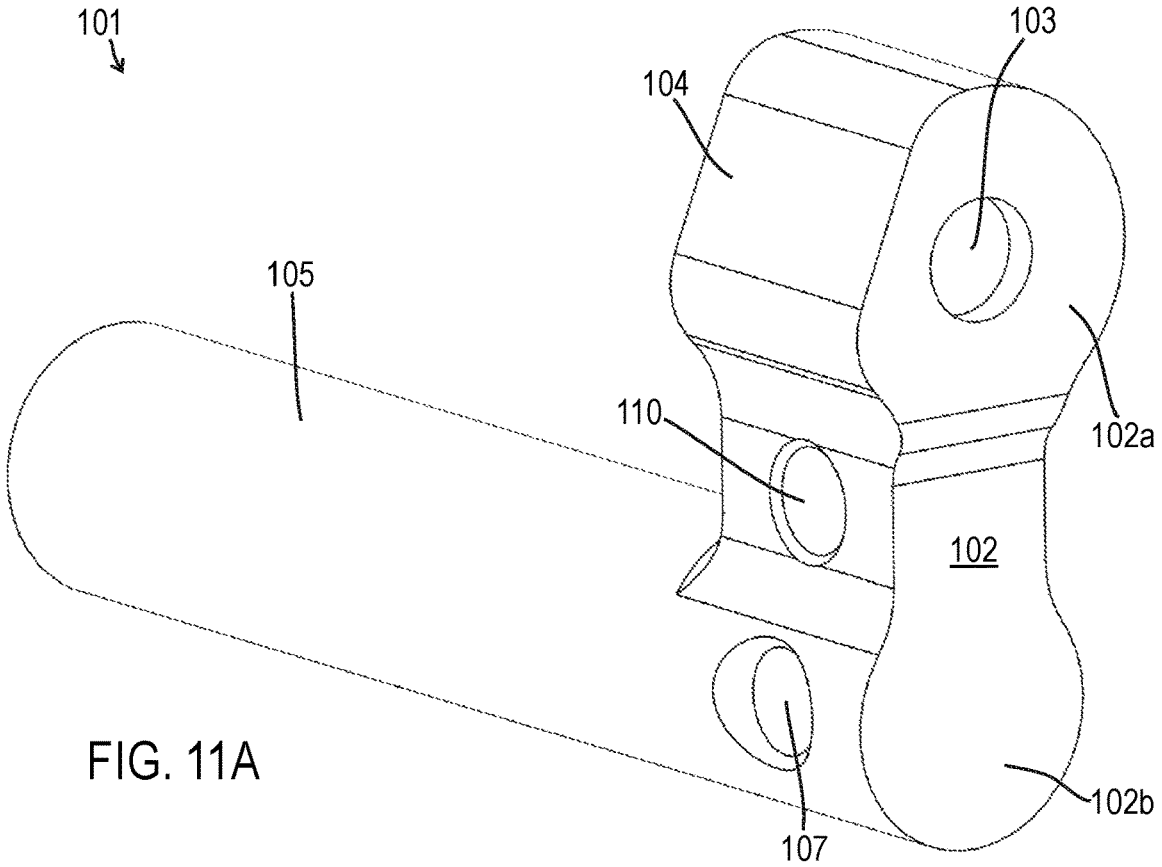
FIG. 11A is a front right perspective view of an ejector of the bolt of FIG. 2.

In some embodiments, the ejector 101 interfaces with the ejector cavity 3101 of the bolt 3020. As shown in FIGS. 3-6B, in some embodiments, the ejector 101 includes a forward interface 102, a rear protrusion 105, and a hole 107. The forward interface 102 may include the entire front facing surface of the ejector 101 and/or may protrude forward relative to the other portions of the ejector 101 such that the forward interface 102 is the only portion of the ejector 101 that contacts a cartridge disposed adjacent to a forward side of the bolt 3020 (e.g., see FIGS. 10-11B). In some examples, as shown in FIG. 11A, the forward interface 102 includes a contact surface 102*a* that protrudes forward and a secondary surface 102*b* that is offset rearward from the contact surface 102*a*. The rear protrusion 105 of the ejector 101 may extend into a corresponding hole 3111 of the bolt 3020 and interface with a spring (e.g., spring 120) within the hole 3111. FIGS. 2, 3, and 10 show examples where the hole 3111 of the bolt 3020 is located at the 6 o'clock (bottom) position when viewing the forward face 3103 of the bolt 3020. FIG. 9 shows another example where the hole 3111 of the bolt 3020 is located at the 4 o'clock position (and/or at a location that is 180° from the extractor 201) when viewing the forward face 3103 of the bolt 3020.

The ejector 101 may be designed to include a portion that extends away from the location of the hole 3111 on the forward face 3103. For example, FIG. 10 shows an example where the ejector 101 extends around the perimeter of the forward face 3103 and locates the forward interface 102 on the perimeter of the forward face 3103 at a position that is approximately 180° from the extractor 201 (at a maximum distance from the extractor 201). Such a configuration provides the longest possible moment arm for the ejector 101 relative to the pivot point created by the extractor 201. However, such a configuration maximizes the necessary travel or necessary displacement for the ejector 101. In addition, during rearward travel of the bolt 3020 after exiting the chamber, the cartridge (or an empty shell of a cartridge if a round was fired) may not be sitting flat against the forward face 3103 because the forward end of the cartridge/shell may be pushed against the inner surface of the barrel extension 3060. For example, the ejector 101 may push the cartridge/shell and the cartridge/shell may pivot relative to the extractor 201. When the cartridge/shell is angled relative to the forward face 3103 (as described above), some of the travel length of the ejector is depleted. This depletion can be affected in two ways. First, shorter cartridges/shells (such as handgun caliber) can pivot more, which depletes more travel of the ejector 101. Second, a longer relative distance of the ejector from the extractor creates more room for the ejector to travel before the bolt 3020 reaches the ejection port 31 of the upper receiver 30. As described in more detail below, ejection can be improved by shortening the length between the ejector 101 and the extractor 201, assuming that the strength of the spring 120 is sufficient to overcome the shorter moment arm.

Figure 7:
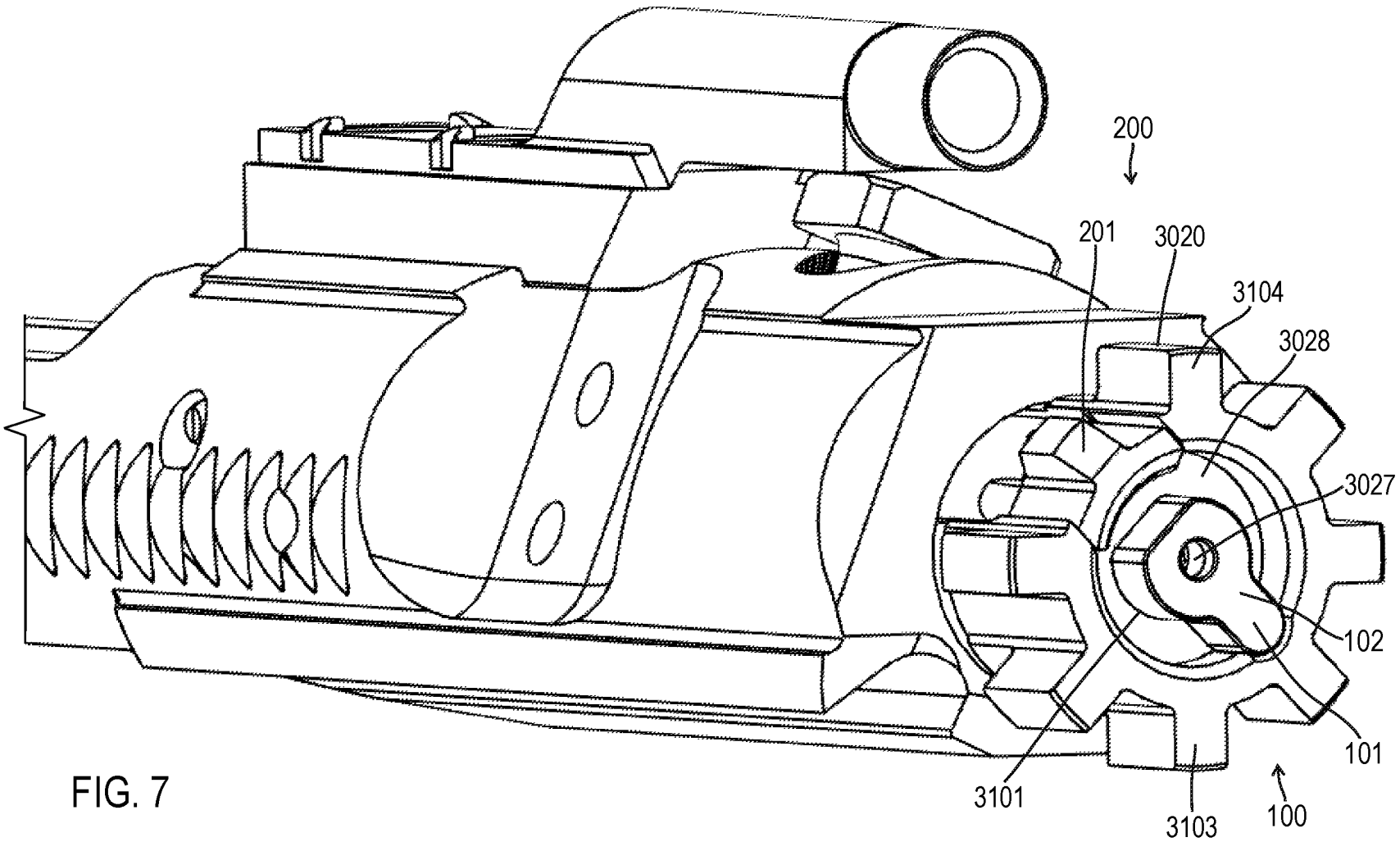
FIG. 7 is a front right partial perspective view of a bolt carrier group including a bolt and an ejector mechanism of the firearm of FIG. 1.

As shown in FIGS. 2, 3, and 7, to improve ejection strength, reliability, and repeatability, the ejector 101 may be designed to extend toward the center of the forward face 3103, which reduces the length between the ejector 101 and the extractor 201. The ejector 101 may be designed to extend to or adjacent to a portion of the forward face 3103 through which the firing pin 3080 extends. In some embodiments, the ejector 101 extends to the portion of the forward face 3103 and includes a hole 103 for the firing pin 3080. The hole 103 may include a counterbore 108 to provide sufficient clearance for the firing pin 3080.

Accordingly, the ejector 101 may be designed such that the rear protrusion 105 extends rearward at the 6 o'clock position when viewing the forward face 3103 of the bolt 3020. To install the ejector 101 into the bolt 3020, a spring 120 is inserted into hole 3111 such that the opposite end of the spring 120 will bottom out in cavity 106 (or against rear surface 109), which will compress when the ejector 101 is pushed rearward. After inserting the ejector 101 into the ejector cavity 3101, the ejector 101 is adjusted such that the hole 107 is aligned with a portion of hole 3115 (between forward end 3115.1 and rear end 3115.2) of the bolt 3020 and a retaining pin 3117 is then inserted into hole 3115 and hole 107. The retaining pin 3117 may be a roll pin, a solid pin, or any other appropriate configuration used to retain the ejector 101. The ejector spring 120 is compressed within hole 3111 when the ejector 101 is pushed rearward. For example, when a rim of a cartridge is retained by extractor 201, the rear surface of the cartridge presses the ejector 101 rearward such that the forward interface 102 is approximately flush with a rear wall or floor of the forward cavity 3028. In some embodiments, when the forward interface 102 is approximately flush with the rear wall of the forward cavity 3028, the rear end 3115.2 of hole 3115 is adjacent to or in contact with retaining pin 3117. When the bolt 3020 moves rearward due to either (i) manual operation/movement (e.g., operating the charging handle) or (ii) cycling of the firearm 1 after firing a cartridge, the spring in hole 3111 pushes the ejector 101 forward such that once the forward face 3103 reaches the ejection port 31 of the upper receiver 30, the ejector 101 pushes the rear surface of a cartridge (or an empty shell of a cartridge if a round was fired) causing the cartridge/shell to pivot about the extractor 201 and exit the firearm 1. The bolt 3020 may be configured with a smaller hole that extends through hole 3111 to the rear face 3107 of the bolt 3020 which allows the operator to push the ejector spring out of the hole 3111 from the rear.

Figure 5A:
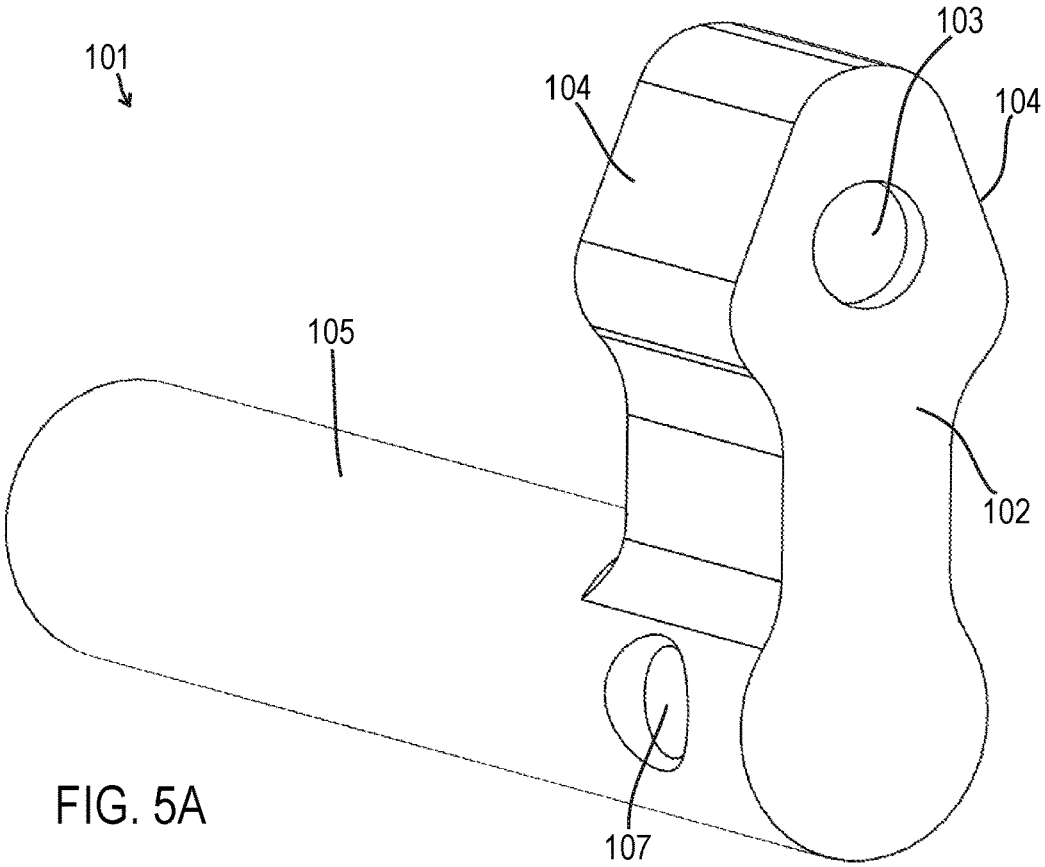
FIG. 5A is a front right perspective view of an ejector of the bolt of FIG. 2.
Figure 5B:
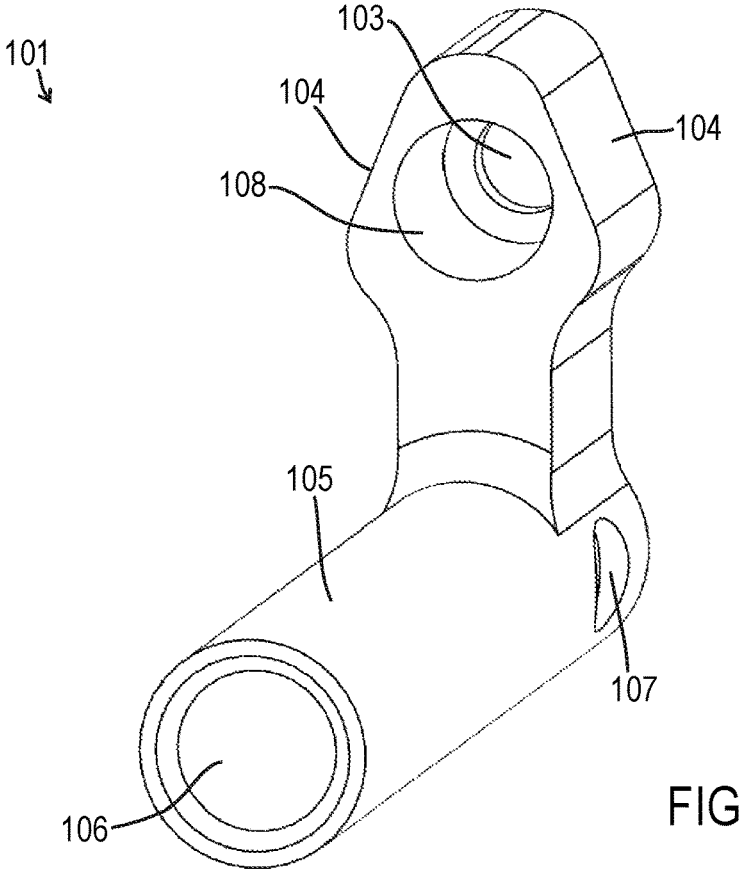
FIG. 5B is a rear right perspective view of the ejector of FIG. 5A.

The shape of the ejector 101 and the corresponding cavity 3101 of the bolt 3020 may be based on creating an offset from the location of the firing pin hole (central hole 3027) through the bolt. In some embodiments, the cavity 3101 includes a flat wall and the ejector 101 includes a flat surface 104 designed to create a minimum offset from the extractor cavity 3102 (see FIGS. 4A and 4B). As shown in FIGS. 5A and 5B, the ejector 101 may be designed for an ambidextrous system where the extractor 201 can be located on either side of the bolt 3020 and the ejector 101 has two flat surfaces 104. Although the surface 104 is illustrated as flat/planar and parallel to the extractor cavity 3102, the surface 104 may be a curved or otherwise nonplanar surface and/or may be nonparallel to the extractor cavity 3102. In some embodiments, the shape or contour of the surface 104 is designed to affect or control the flight of the cartridge/shell being ejected.

In some embodiments, the size and/or shape of the ejector 101 near the firing pin hole 103 is designed to increase safety. For example, the portion of the ejector 101 in this area may be designed to be larger (or in some cases significantly larger) than the primer for the appropriate cartridge.

Figure 6A:
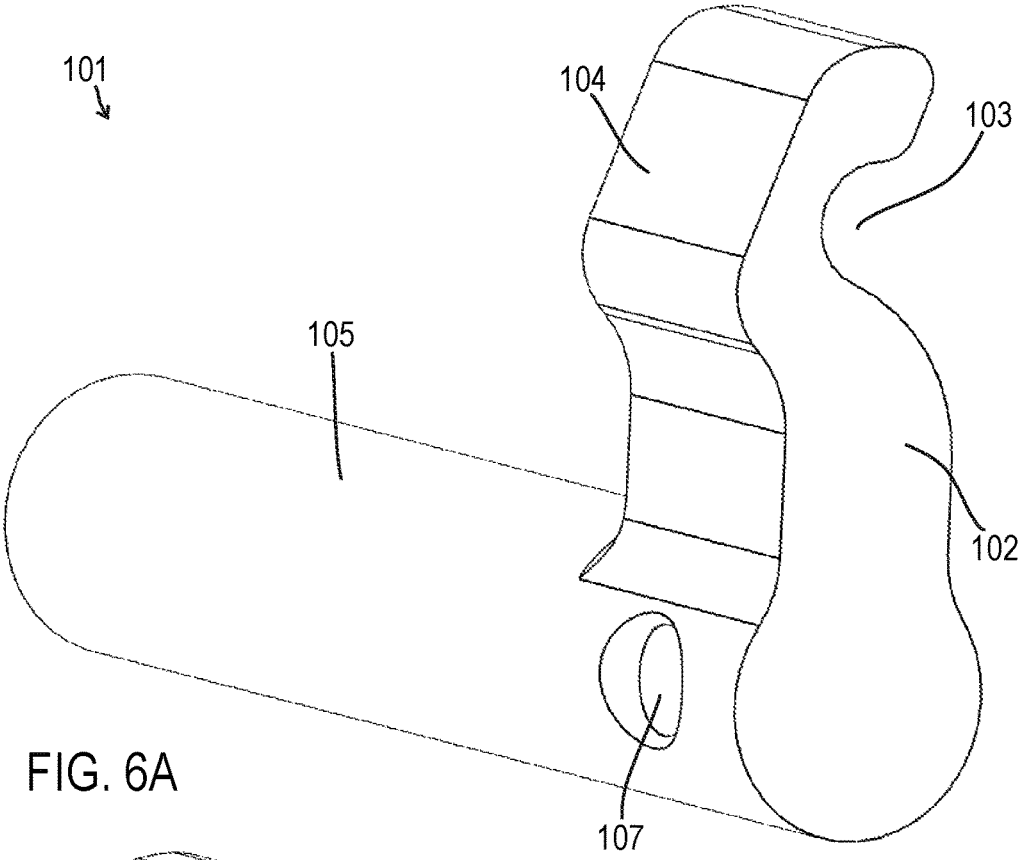
FIG. 6A is a front right perspective view of an ejector of the bolt of FIG. 2.
Figure 6B:
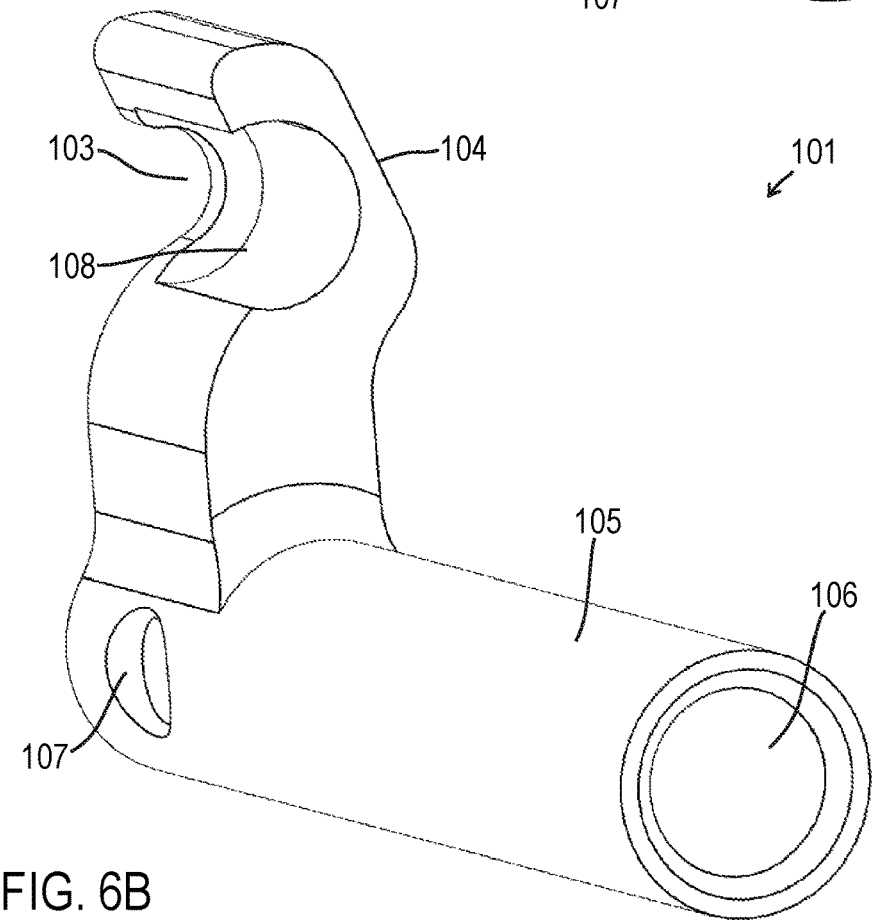
FIG. 6B is a rear right perspective view of the ejector of FIG. 6A.

As illustrated in FIGS. 6A and 6B, the ejector 101 may be designed to only partially surround or enclose the firing pin hole 103. For example, the ejector 101 may extend up from the hole 3111 and stop short of the central hole 3027. In some embodiments, the ejector 101 includes a hole 103 that surrounds or encloses the bottom side of the central hole 3027. In other embodiments, the ejector 101 includes a hole 103 that surrounds or encloses the right side of the central hole 3027, along with portions of the bottom side and the top side (as shown in FIGS. 6A and 6B). In other embodiments, the ejector 101 includes a hole 103 that surrounds or encloses at least a portion of the left side of the central hole 3027. The hole 103 may surround approximately half of the central hole 3027. In other cases, the hole 103 may surround approximately 10%, 20%, 30%, 40%, 60%, 70%, 80%, 90% or any other appropriate portion of the central hole 3027. In some embodiments, the entire ejector 101 is located at or near the center of the forward face 3103 of the bolt 3020 (i.e., there is no rear protrusion 105).

Figure 8A:
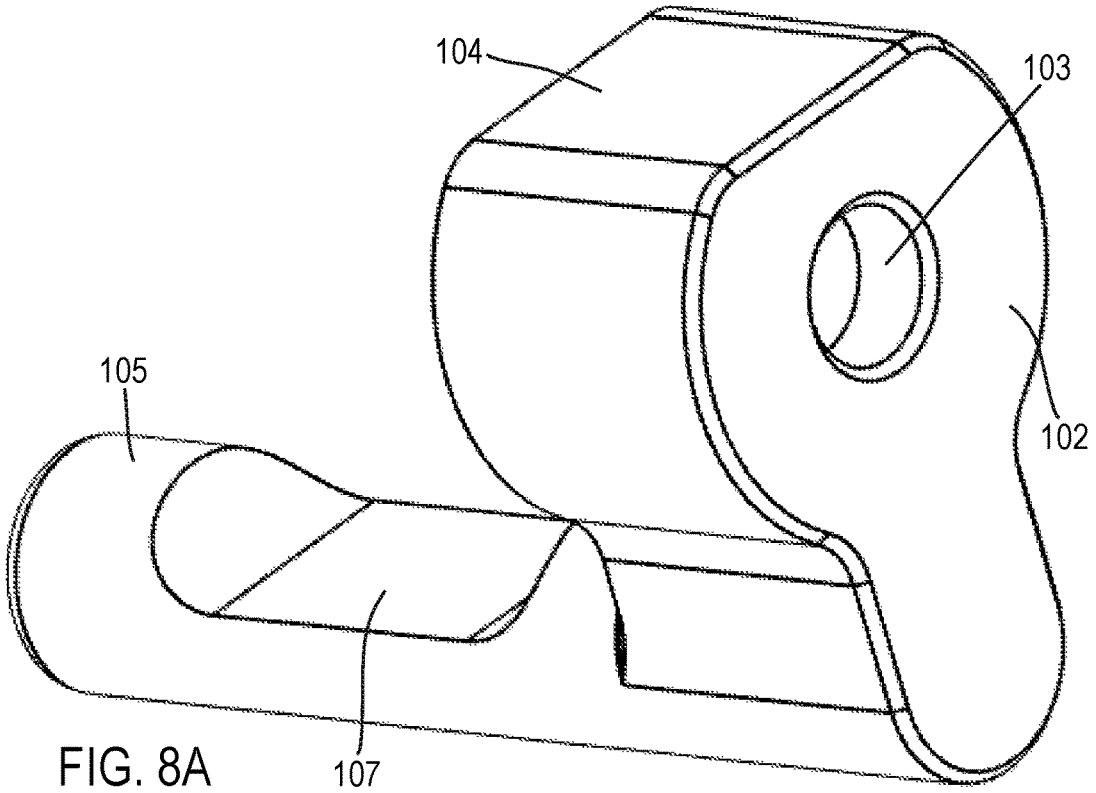
FIG. 8A is a front right perspective view of an ejector of the bolt of FIG. 7.
Figure 8B:
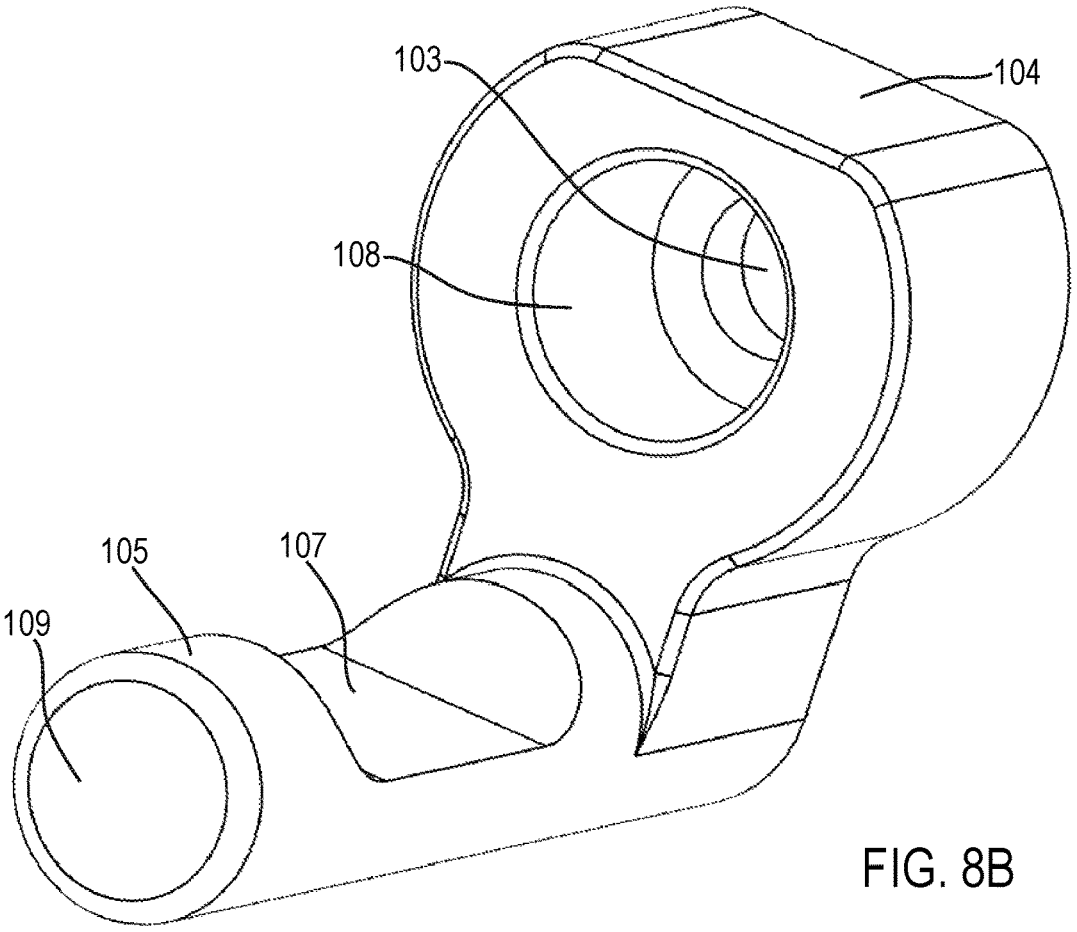
FIG. 8B is a rear right perspective view of the ejector of FIG. 8A.

As shown in FIGS. 7-9, ejector 101 as described above can be adapted to function with an otherwise standard AR-15 style bolt carrier group. The rear protrusion 105 extends into hole 3111, which is in a typical location for a standard AR-15 ejector. However, as shown in FIG. 9, the bolt 3020 includes a cavity 3101 for the ejector 101 that is not typical for AR-15 bolt carrier groups. The ejector 101 shown in FIGS. 7-8B improves the strength, reliability, and repeatability of the ejection for an AR-15 bolt carrier group.

The extractor 201 may be located within the extractor cavity 3102 of the bolt 3020 such that the extractor 201 can move based on the geometry of the cavity 3102 and an interface with an extractor plunger 203 inserted into extractor spring cavity 3122. As shown in FIG. 3, the extractor 201 may include a front surface 207, a hook member 204, and a rear member 206. In some embodiments, the extractor 201 rotates and lip 204 engages the rim of a cartridge or empty shell. In some embodiments, as shown in FIG. 3, the extractor 201 includes a protrusion 205 that locates and defines movement of the extractor 201 relative to the bolt 3020 (in coordination with the extractor plunger 203 as described below). The protrusion 205 may engage a corresponding recess within the extractor cavity 3102 (e.g., see cylindrical recess within extractor cavity 3102 in FIG. 3). The hook member 204 of extractor 201 may be configured to engage a cannelure and/or a rim of the cartridge such that the extractor 201 guides the cartridge (or the empty shell of a cartridge if a round was fired) in the direction of the ejection port 31 of the upper receiver 30 using the force provided by the ejector 101. In some embodiments, the extractor 201 includes at least one opening 202 that allows excess gas and carbon to escape from the cavity 3102.

In some embodiments, rotation of the extractor 201 depends on an interface with the extractor plunger 203. The extractor plunger 203 may include a rear portion 203.4, a front portion 203.3, a rear surface 203.1, and a surface 203.2. In some cases, the rear portion 203.4 may be cylindrical and the front portion 203.3 may include a blade shape having a flat portion and/or a rectangular cross section. A spring 220 may be inserted into hole 3122. The extractor plunger 203 is then inserted into hole 3122 of the bolt 3020 and the spring 220 is compressed against the rear surface 203.1 such that the surface 203.2 is approximately aligned and/or continuous with profile surface 3105 of the bolt 3020. In some embodiments, the front portion 203.3 presses against the rear member 206 of the extractor 201 to bias the extractor 201 toward engagement with a cartridge. The bolt 3020 may be configured with a smaller hole that extends through hole 3122 to the rear face 3107 of the bolt 3020 which allows the operator to push the extractor spring 220 out of the hole 3122 from the rear.

When the bolt 3020 moves forward over the top of a magazine, the lower portion 3108 pushes the upper-most cartridge out of the magazine and toward the barrel extension 3060 and the chamber of the firearm 1. In some embodiments, the bolt 3020 may include a gap 3108.1 in the lower portion 3108, which allows excess gas and carbon to escape from the forward cavity 3028.

When the cartridge is in the chamber in a firing position, the cartridge is approximately aligned with a center of the forward face 3103 of the bolt 3020 such that the central hole 3027 of the bolt 3020 and/or the hole 103 of the ejector 101 are aligned with the primer of the cartridge (to align the forward end 3081 of the firing pin 3080 with the cartridge). When the cartridge is in the firing position, forward motion of the firing pin 3080 (e.g., caused by a hammer interacting with the rear end 3083 of the firing pin 3080) causes the cartridge to discharge.

Figure 11B:
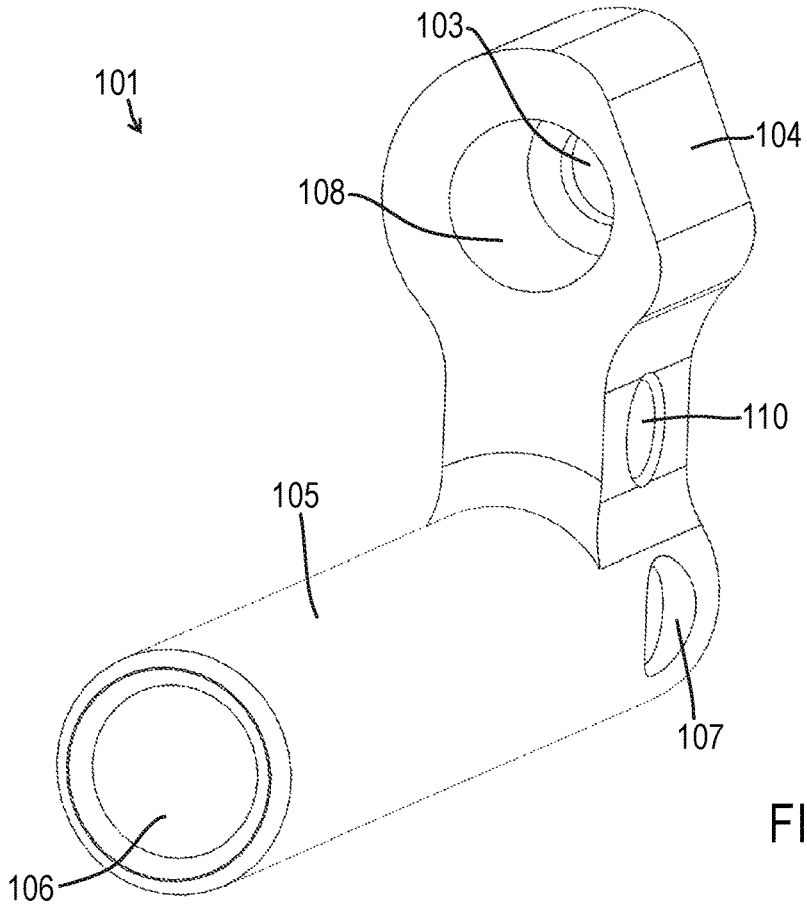
FIG. 11B is a rear right perspective view of the ejector of FIG. 11A.

In some embodiments, as shown in FIGS. 11A and 11B, the ejector 101 may include a hole 110 between the firing pin hole 103 and the rear protrusion 105. The hole 110 may provide heat transfer benefits such that less heat is transferred from the upper portion of the ejector 101 to the rear protrusion 105 (and the spring 120). For example, the hole may provide additional surface area for convective heat transfer and may reduce the amount of material for conducting heat toward the spring 120. In some cases, the hole 110 is a through hole extending through the ejector 101 while in other cases, the hole 110 is a blind hole.

The components of any of the firearms 1 described herein may be formed of materials including, but not limited to, thermoplastic, carbon composite, plastic, nylon, polyetherimide, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An ejector mechanism for a firearm comprising:
an ejector disposed at a forward face of a bolt,
wherein the ejector comprises a hole designed to provide clearance for a firing pin to pass at least partially through the ejector.

2. The ejector mechanism of claim 1, wherein the hole comprises a counterbore on a rear side of the ejector.

3. The ejector mechanism of claim 1, wherein the ejector comprises a rear protrusion that extends into a corresponding hole in the bolt.

4. The ejector mechanism of claim 3, wherein the corresponding hole in the bolt is disposed at a location on the forward face distal from the firing pin.

5. The ejector mechanism of claim 3, wherein the corresponding hole in the bolt is disposed at bottom of the forward face.

6. The ejector mechanism of claim 3, further comprising a spring disposed within the corresponding hole in the bolt.

7. The ejector mechanism of claim 1, wherein the ejector comprises a flat surface such that the flat surface is defined by an offset from an extractor cavity of the bolt.

8. The ejector mechanism of claim 1, wherein the ejector comprises a symmetric shape with at least two flat surfaces such that a first flat surface is compatible with an extractor on a right side of the bolt and a second flat surface is compatible with an extractor on a left side of the bolt.

9. The ejector mechanism of claim 1, wherein the ejector comprises a forward interface comprising (i) a contact surface that protrudes forward and (ii) a secondary surface that is offset rearward from the contact surface.

10. The ejector mechanism of claim 1, wherein the ejector comprises a retaining hole configured to interface with a retaining pin.

11. An ejector mechanism for a firearm comprising:
an ejector disposed at a forward face of a bolt,
wherein at least a portion of the ejector is disposed at a center of the forward face of the bolt.

12. The ejector mechanism of claim 11, wherein the ejector comprises a hole designed to provide clearance for a firing pin to pass at least partially through the ejector.

13. The ejector mechanism of claim 12, wherein the hole comprises a counterbore on a rear side of the ejector.

14. The ejector mechanism of claim 11, wherein the ejector comprises a rear protrusion that extends into a corresponding hole in the bolt.

15. The ejector mechanism of claim 14, wherein the corresponding hole in the bolt is disposed at a location on the forward face distal from the firing pin.

16. The ejector mechanism of claim 14, wherein the corresponding hole in the bolt is disposed at bottom of the forward face.

17. The ejector mechanism of claim 11, wherein the ejector comprises a flat surface such that the flat surface is defined by an offset from an extractor cavity of the bolt.

18. The ejector mechanism of claim 11, wherein the ejector comprises a symmetric shape with at least two flat surfaces such that a first flat surface is compatible with an extractor on a right side of the bolt and a second flat surface is compatible with an extractor on a left side of the bolt.

19. The ejector mechanism of claim 11, wherein the ejector comprises a forward interface comprising (i) a contact surface that protrudes forward and (ii) a secondary surface that is offset rearward from the contact surface.

20. The ejector mechanism of claim 11, wherein the ejector comprises a retaining hole configured to interface with a retaining pin.

* * * * *